US011828513B2

(12) United States Patent
Ito

(10) Patent No.: US 11,828,513 B2
(45) Date of Patent: Nov. 28, 2023

(54) APPARATUS FOR RECONDENSING HELIUM FOR CRYOSTAT

(71) Applicant: JAPAN SUPERCONDUCTOR TECHNOLOGY INC., Hyogo (JP)

(72) Inventor: Satoshi Ito, Kobe (JP)

(73) Assignee: JAPAN SUPERCONDUCTOR TECHNOLOGY INC., Hyogo (JP)

( * ) Notice: Subject to any disclaimer, the term of this patent is extended or adjusted under 35 U.S.C. 154(b) by 0 days.

(21) Appl. No.: 17/755,263

(22) PCT Filed: Oct. 15, 2020

(86) PCT No.: PCT/JP2020/038894
§ 371 (c)(1),
(2) Date: Apr. 25, 2022

(87) PCT Pub. No.: WO2021/085157
PCT Pub. Date: May 6, 2021

(65) Prior Publication Data

US 2022/0397311 A1 Dec. 15, 2022

(30) Foreign Application Priority Data

Nov. 1, 2019 (JP) ..... 2019-199515

(51) Int. Cl.
*F25B 9/00* (2006.01)
*F25B 9/10* (2006.01)
*H01F 6/04* (2006.01)

(52) U.S. Cl.
CPC ..... *F25B 9/002* (2013.01); *F25B 9/10* (2013.01); *H01F 6/04* (2013.01); *F25B 2400/17* (2013.01)

(58) Field of Classification Search
CPC ..... F25B 9/002; F25B 9/10; F25B 2400/17; H01F 6/04
See application file for complete search history.

(56) References Cited

U.S. PATENT DOCUMENTS 5,092,130 A 3/1992 Nagao et al.
5,144,805 A 9/1992 Nagao et al.
(Continued)

FOREIGN PATENT DOCUMENTS

EP 1 586 833 A2 10/2005
JP S56-082360 A 7/1981
(Continued)

OTHER PUBLICATIONS

The extended European search report issued by the European Patent Office dated Nov. 8, 2022, which correspond to European Patent Application No. 20882357.5-1016 and is related to U.S. Appl. No. 17/755,263.

(Continued)

*Primary Examiner* — David J Teitelbaum
(74) *Attorney, Agent, or Firm* — Studebaker & Brackett PC

(57) ABSTRACT

Provided is a helium recondensation apparatus for a cryostat, which can stably recondense vapor of helium in the cryostat while preventing a pipeline for the recondensation from being clogged. A recondensation apparatus includes a freezer, a first heat exchanger, a first recondensing chamber, and a first connection part. The first heat exchanger stores heat-exchanging helium in a helium tank included in an NMR apparatus, and permits the heat-exchanging helium to evaporate owing to heat of vaporization taken from vapor of coolant helium in the helium tank, thereby permitting the coolant helium to recondense through heat exchange with the heat-exchanging helium. The first connection part is separated from the coolant helium in the helium tank and permits the heat-exchanging helium to flow between the first heat exchanger and the first recondensing chamber therethrough.

14 Claims, 9 Drawing Sheets

(56) References Cited

U.S. PATENT DOCUMENTS

| | | | | |
|---|---|---|---|---|
| 5,144,810 | A * | 9/1992 | Nagao | F04B 37/08 165/4 |
| 5,154,063 | A | 10/1992 | Nagao et al. | |
| 5,251,456 | A | 10/1993 | Nagao et al. | |
| 5,293,749 | A | 3/1994 | Nagao et al. | |
| 5,293,752 | A | 3/1994 | Nagao et al. | |
| 5,365,743 | A | 11/1994 | Nagao et al. | |
| 5,447,033 | A | 9/1995 | Nagao et al. | |
| 2005/0229609 | A1 * | 10/2005 | Kirichek | F25B 9/02 62/51.1 |
| 2007/0051116 | A1 | 3/2007 | Glemot et al. | |
| 2008/0209919 | A1 * | 9/2008 | Ackermann | G01R 33/3815 62/51.1 |
| 2009/0224862 | A1 * | 9/2009 | Mikheev | H01F 6/04 335/216 |
| 2015/0007586 | A1 * | 1/2015 | Kraus | F25D 19/00 62/51.1 |
| 2015/0099640 | A1 * | 4/2015 | Kasahara | H01B 12/16 361/699 |
| 2017/0038123 | A1 * | 2/2017 | Strickland | F25B 9/00 |
| 2017/0363697 | A1 * | 12/2017 | Jonas | G01R 33/3804 |
| 2019/0214695 | A1 | 7/2019 | Miura et al. | |

FOREIGN PATENT DOCUMENTS

| | | | |
|---|---|---|---|
| JP | S63-038862 | A | 2/1988 |
| JP | H02-081361 | U | 6/1990 |
| JP | H02-298765 | A | 12/1990 |
| JP | H07-198278 | A | 8/1995 |
| JP | 2002-303463 | A | 10/2002 |
| JP | 2006-046896 | A | 2/2006 |
| JP | 2007-051850 | A | 3/2007 |
| WO | 2018/055944 | A1 | 3/2018 |

OTHER PUBLICATIONS

International Search Report issued in PCT/JP2020/038894; dated Dec. 15, 2020.

* cited by examiner

APPARATUS FOR RECONDENSING HELIUM FOR CRYOSTAT

TECHNICAL FIELD

The present invention relates to a helium recondensation apparatus for a cryostat, which is connectable to the cryostat for recondensing vapor of a helium coolant.

BACKGROUND ART

Cryostats each serving as a thermally-insulating container for keeping a cooled object at a very low temperature have been conventionally known. Technologies using such a cryostat include adoption of an NMR (Nuclear Magnet Resonance) apparatus having been widely utilized in chemical fields, medical and agrochemical fields, and industrial fields to know a bonding state between molecules. A strong magnetic field is required for measurement such NMR, and hence a superconducting magnet (cooled object) made of metal-based superconducting material, such as NbTi and Nb3Sn, is used for the NMR apparatus. The metal-based superconducting material shifts to a super conducting state only at a very low temperature. Therefore, the NMR apparatus has the aforementioned cryostat, and the superconducting magnet is immersed in liquid helium at a very low temperature in the cryostat so as to be continuously cooled. The cryostat has a helium container for storing the liquid helium and a vacuum-insulating container for accommodating the helium container. The liquid helium has a boiling point of 4.2K at an atmospheric pressure. For suppressing evaporation of the liquid helium, the helium container containing the superconducting magnet therein is accommodated in the vacuum-insulating container so as to be vacuum-insulated.

The liquid helium steadily evaporates and continues to reduce even in the cryostat. Here, Patent Literature 1 discloses a helium recondensation apparatus which prevents helium from reducing by recondensing vapor of the helium evaporating from a helium tank included in an NMR apparatus. The recondensation apparatus includes: a cryogenic freezer located above the NMR apparatus; a helium recondensing tank cooled by the cryogenic freezer; and a pipeline for sending out the vapor of the helium in the helium tank from the NMR apparatus to the helium recondensing tank, and returning the helium recondensed in the helium recondensing tank to the NMR apparatus.

The vapor of helium gas from the helium tank of the NMR apparatus flows into the helium recondensing tank through a flexible pipeline to be cooled by a cold head of the cryogenic freezer, and then recondensed and liquefied. The liquefied helium reflows into the helium tank of the NMR apparatus through the pipeline, and therefore a reduction in the liquid helium in the NMR apparatus is suppressible. This configuration where the pipeline connects the helium recondensing tank and the helium tank to each other suppresses propagation of vibration caused by the freezer to the NMR apparatus more effectively than a configuration where a cryogenic freezer is directly mounted on an NMR apparatus.

CITATION LIST

Patent Literature

Japanese Unexamined Patent Publication No. 2007-51850

The technology disclosed in Patent Literature 1 has a problem of difficulty in a stable operation of the NMR apparatus due to a high likelihood of clogging occurrence in the pipeline which connects the NMR apparatus and the recondensation apparatus to each other for permitting the helium in the helium tank to flow therethrough. Specifically, liquid helium is supplied from a predetermined helium tank into the helium tank prior to the operation of the NMR apparatus. At this time, a slight amount of an air component, such as nitrogen and oxygen, may enter the helium tank. In this respect, the technology disclosed in Patent Literature 1 has the problem of the difficulty in the operation of the NMR apparatus since the air component is frozen in the pipeline and clogs the pipeline while the helium in the helium tank of the NMR apparatus repetitively flows between the NMR apparatus and the helium recondensing tank located outside the NMR apparatus through the pipeline.

SUMMARY OF INVENTION

The present invention has been achieved in view of the aforementioned problem, and an object of the present invention is to provide a helium recondensation apparatus for a cryostat, which can stably recondense vapor of helium in the cryostat while preventing a pipeline for the recondensation from being clogged.

A helium recondensation apparatus for a cryostat according to one aspect of the present invention is a helium recondensation apparatus for a cryostat which includes a helium tank tightly closed to store coolant helium in liquid and accommodates a cooled object immersed in the coolant helium, the apparatus being connectable to the cryostat for recondensing vapor of the coolant helium in the helium tank. The helium recondensation apparatus for a cryostat includes: a freezer located away from the cryostat and including a main cooling part kept at a very low temperature; and a helium recondensing unit which recondenses the coolant helium in the helium tank by receiving cold energy from the main cooling part of the freezer. The helium recondensing unit includes: a first heat exchanger located above a liquid surface of the coolant helium in the helium tank, and having a first inner space separated from the coolant helium in the helium tank for storing heat-exchanging helium in liquid, the heat exchanger taking heat of vaporization for evaporation of the heat-exchanging helium in the inner space, from the vapor of the coolant helium in the helium tank; a first recondensing chamber located away from the cryostat but in thermally contact with the main cooling part, and configured to receive vapor of the heat-exchanging helium in the first inner space, recondense and liquefy the received vapor of the heat-exchanging helium by receiving the cold energy from the main cooling part, and discharge the recondensed and liquefied heat-exchanging helium; a support mechanism which supports the first recondensing chamber so that the first recondensing chamber is at a higher position than the helium tank; and a first connection part continuously extending downward from the first recondensing chamber to the first heat exchanger located in the cryostat to define a flow passage for permitting the heat-exchanging helium to flow between the first recondensing chamber and the first heat exchanger so that the heat-exchanging helium discharged from the first recondensing chamber flows to the first inner space of the first heat exchanger by gravity.

DESCRIPTION OF EMBODIMENTS

Figure 1:
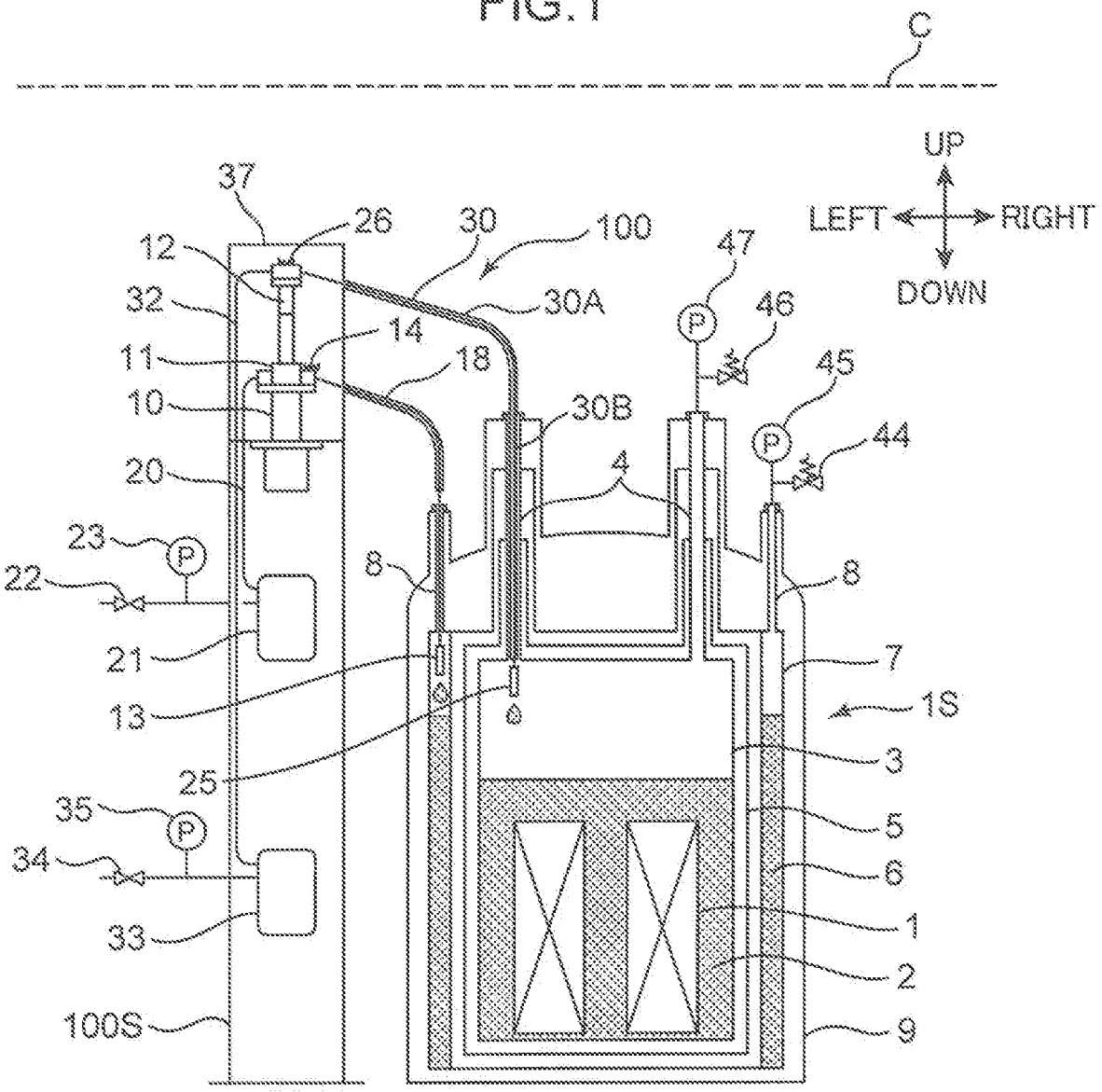
FIG. 1 is a cross-sectional view showing a state where a helium recondensation apparatus for a cryostat according to an embodiment of the present invention is connected to an NMR apparatus.
Figure 2:
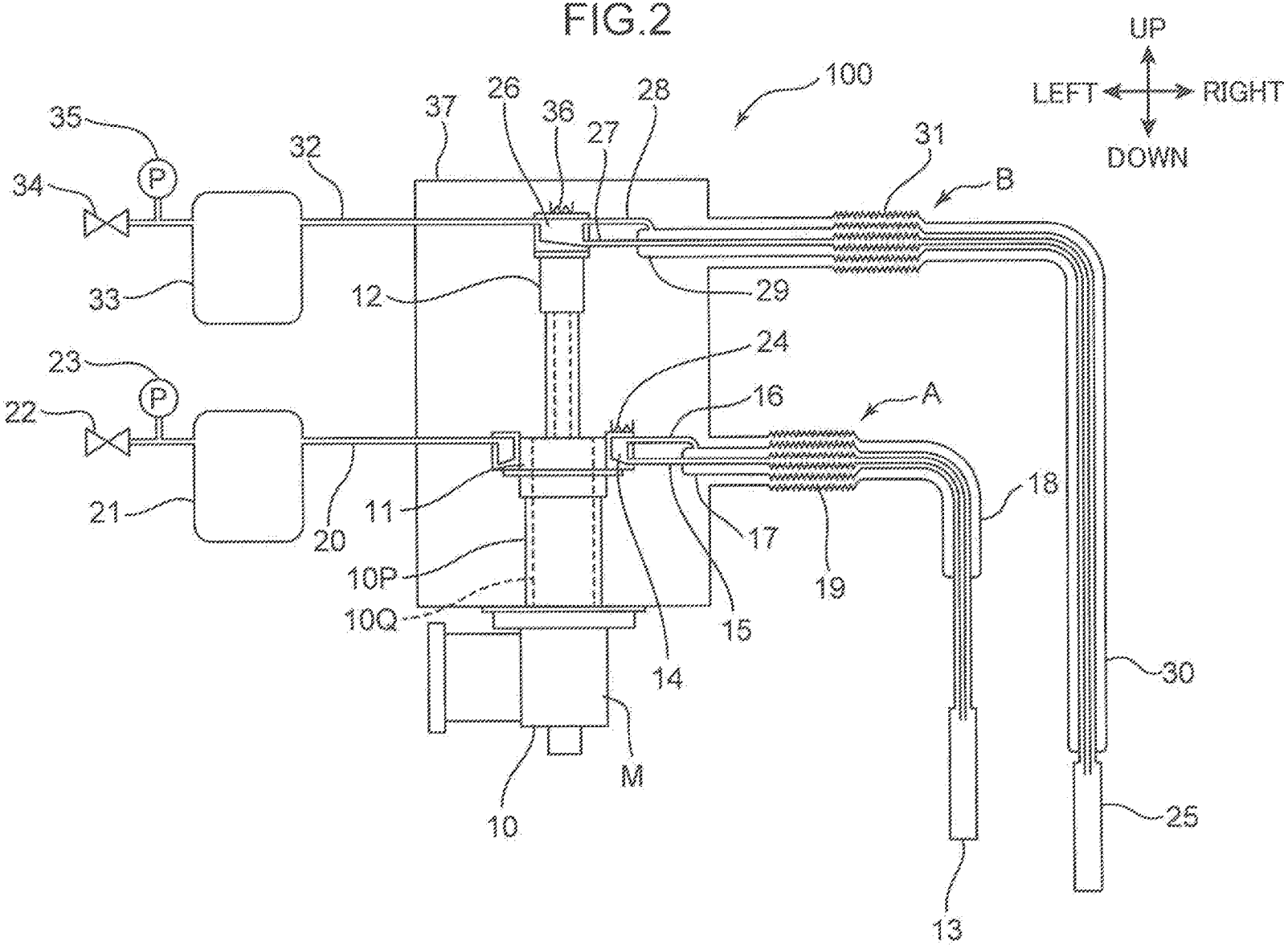
FIG. 2 is a cross-sectional view of the helium condensation apparatus for a cryostat according to the embodiment of the present invention.

Hereinafter, a recondensation apparatus 100 (helium recondensation apparatus for a cryostat) according to each embodiment of the present invention will be described with reference to accompanying drawings. FIG. 1 is a cross-sectional view showing a state where the recondensation apparatus 100 according to an embodiment of the present invention is connected to an NMR apparatus 1S. FIG. 2 is a cross-sectional view of the recondensation apparatus 100 according to the embodiment. Here, each drawing illustrates directions "UP", "DOWN", "LEFT", and "RIGHT" for explanation, but these directions do not delimit any structure and use way of the helium recondensation apparatus for a cryostat according to the present invention.

The recondensation apparatus 100 is connected to the NMR apparatus 1S serving as an exemplary cryostat in the embodiment.

The NMR apparatus 1S includes: a superconducting magnet 1 (cooled object); a helium tank 3 tightly closed to store liquid helium 2 (coolant helium); a plurality of helium ports 4 each communicating with the helium tank 3; a gas cooling radiation shield 5; a nitrogen tank 7 (auxiliary coolant tank) tightly closed to store liquid nitrogen 6 (a thermally-insulating auxiliary coolant); a plurality of nitrogen ports 8 each communicating with the nitrogen tank 7; and a vacuum tank 9.

The superconducting magnet 1 generates a strong magnetic field for measurement in the NMR apparatus 1S. To this end, the superconducting magnet 1 is deeply cooled to a very low temperature and maintained in a superconducting state. The helium tank 3 has a cylindrical shape and stores the liquid helium 2 (coolant helium) therein. The superconducting magnet 1 is accommodated in the helium tank 3 in such a manner as to be immersed in the liquid helium 2 in the helium tank 3. The helium tank 3 (liquid helium container) containing the superconducting magnet 1 in this manner is accommodated in the vacuum tank 9 so as to be vacuum-insulated. As a result, evaporation of the liquid helium is suppressed.

The nitrogen tank 7 further surrounds the helium tank 3 for reducing the heat which enters the helium tank 3. The nitrogen tank 7 stores the liquid nitrogen 6. The gas cooling radiation shield 5 having a cylindrical shape is located between the helium tank 3 and the nitrogen tank 7. The gas cooling radiation shield 5 has a temperature set to around 40 to 50 K with use of cold energy of vapor of the helium in the helium tank 3. Such a multiple-layered thermally-insulating container is called the cryostat.

The helium still evaporates at a speed of 10 to 20 cc/h and the nitrogen evaporates at a speed of 100 to 200 cc/h in use of the NMR apparatus 1S even with the above-described thermally-insulating structure. Therefore, it is desirable to reduce a periodic coolant replenishment work by recondensing the vapor of the helium in the helium tank 3 and the vapor of the nitrogen in the nitrogen tank 7. Besides, a very small electromagnetic wave is observed in the measurement in the NMR apparatus 1S. For improvement of the accuracy (S/N ratio) of the observation, preferably, vibration which propagates to the NMR apparatus 1S is maximally reduced.

The NMR apparatus 1S includes a nitrogen tank check valve 44, a nitrogen tank pressure gauge 45, a helium tank check valve 46, and a helium tank pressure gauge 47. Prior to the use of the NMR apparatus 1S, the helium tank 3 is filled with the liquid helium through one helium port 4 (a right helium port 4 in FIG. 1) among the helium ports 4. Similarly, the nitrogen tank 7 is filled with the liquid nitrogen through one nitrogen port 8 (a right nitrogen port 8 in FIG. 1) among the nitrogen ports 8. Each of the helium tank check valve 46 and the nitrogen tank check valve 44 is disposed to maintain corresponding one of the helium tank 3 and the nitrogen tank 7 at a substantially atmospheric pressure, specifically, at a pressure slightly higher than the atmospheric pressure. The helium tank pressure gauge 47 detects an internal pressure of the helium tank 3, and the nitrogen tank pressure gauge 45 detects an internal pressure of the nitrogen tank 7.

The recondensation apparatus 100 according to the embodiment can recondense each vapor of the helium and the nitrogen in the NMR apparatus 1S. As shown in FIG. 1 and FIG. 2, the recondensation apparatus 100 includes a freezer 10 located away from the NMR apparatus 1S, a nitrogen recondensing unit A (auxiliary coolant recondensing unit), a helium recondensing unit B, a recondensation apparatus vacuum tank 37, and a housing 100S (support mechanism).

The freezer 10 includes a cylinder 10P, a displacer 10Q, a motor M (drive part), and a first cooling stage 11 (subcooling part) and a second cooling stage 12 (main cooling part) each kept at a very low temperature. The cylinder 10P is a member having a cylindrical shape and a central axis extending in an up-down direction. The displacer 10Q is arranged in the cylinder 10P reciprocatively movable upward and downward in the up-down direction for generating cold energy by expanding coolant gas in the cylinder 10P. The motor M is located below the cylinder 10P for generating a drive force to reciprocatively move the displacer 10Q upward and downward.

The first cooling stage 11 is connected to the cylinder 10P above the motor M for cooling a nitrogen recondensing chamber 14 (second recondensing chamber) to be described later by receiving the cold energy. Specifically, the first cooling stage 11 is thermally connected to the nitrogen recondensing chamber 14 for cooling the nitrogen recondensing chamber 14 to allow nitrogen gas (a heat-exchanging auxiliary coolant) to recondense in the nitrogen recondensing chamber 14. The first cooling stage 11 has a circular pipe shape to surround the cylinder 10P.

The second cooling stage 12 is connected to the cylinder 10P above the first cooling stage 11 (at a position different from the first cooling stage 1) for cooling a helium recondensing chamber 26 (first recondensing chamber) by receiving the cold energy. Specifically, the second cooling stage 12 is thermally connected to the helium recondensing chamber 26 for cooling the helium recondensing chamber 26 to allow the helium (heat-exchanging helium) to recondense in the helium recondensing chamber 26. The second cooling stage 12 has a cylindrical shape.

Figure 3:
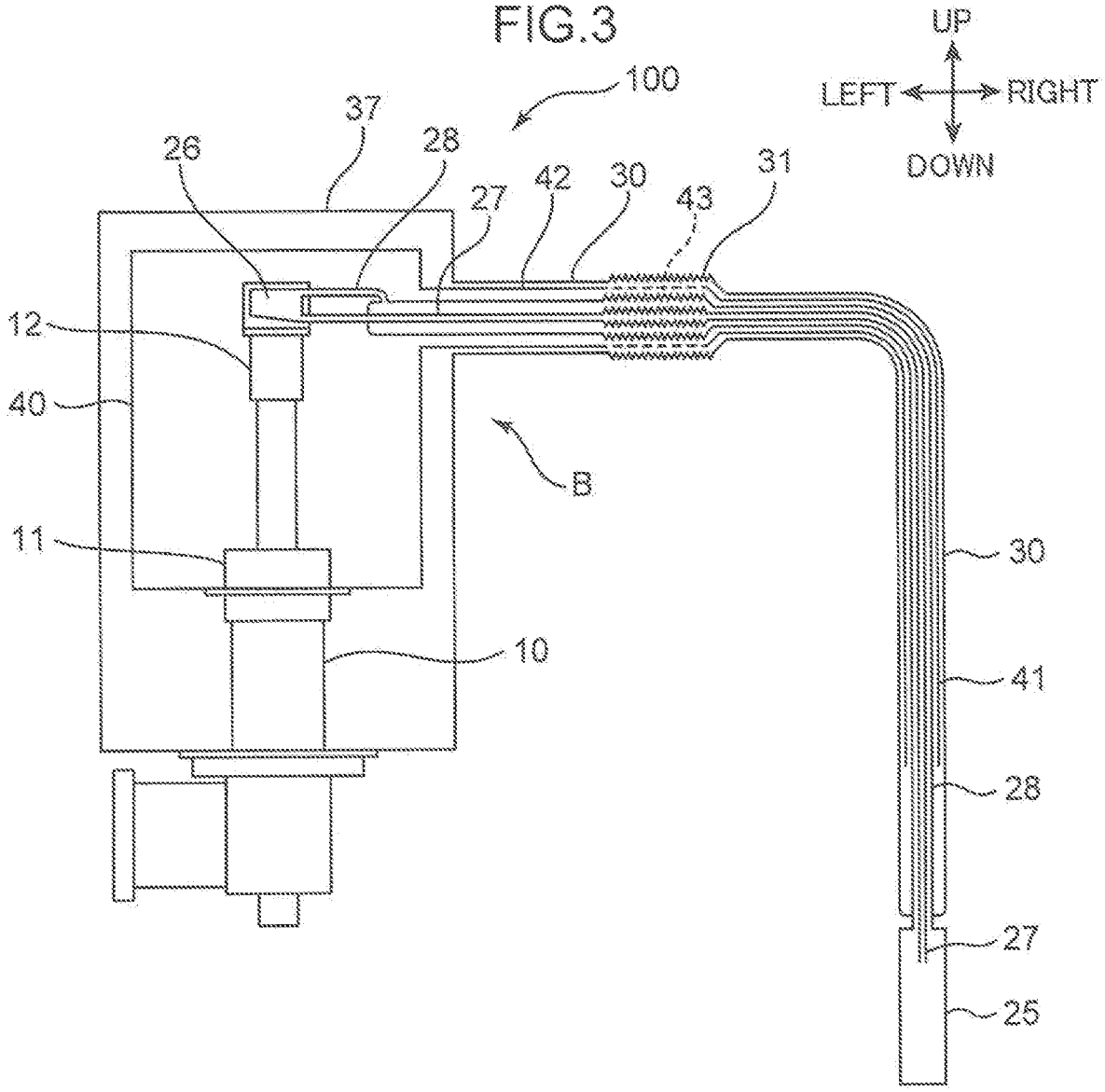
FIG. 3 is an enlarged cross-sectional view of a part of the helium recondensation apparatus for a cryostat according to the embodiment of the present invention.

As shown in FIG. 3, the freezer 10 is surrounded by the recondensation apparatus vacuum tank 37 therearound and is vacuum-insulated by the recondensation apparatus radiation shield 40 (FIG. 3) thereof. The freezer 10 is supported by the housing 100S at a predetermined height position from a floor surface (FIG. 1).

The nitrogen recondensing unit A (FIG. 2) recondenses the thermally-insulating nitrogen in the nitrogen tank 7 by receiving cold energy from the first cooling stage 11 of the freezer 10. The nitrogen recondensing unit A includes: a nitrogen heat exchanger 13 (second heat exchanger); the nitrogen recondensing chamber 14 (second recondensing chamber); a nitrogen backward pipe 15 (second connection part); nitrogen forward pipe 16 (second connection part); a nitrogen forward-backward pipeline header 17; a nitrogen transfer pipe vacuum jacket 18; a nitrogen transfer pipe flexible section 19; a nitrogen supply pipe 20; nitrogen buffer tank 21; a nitrogen supply valve 22; a nitrogen buffer tank pressure gauge 23; and a nitrogen recondensing chamber heater 24.

Figure 4:
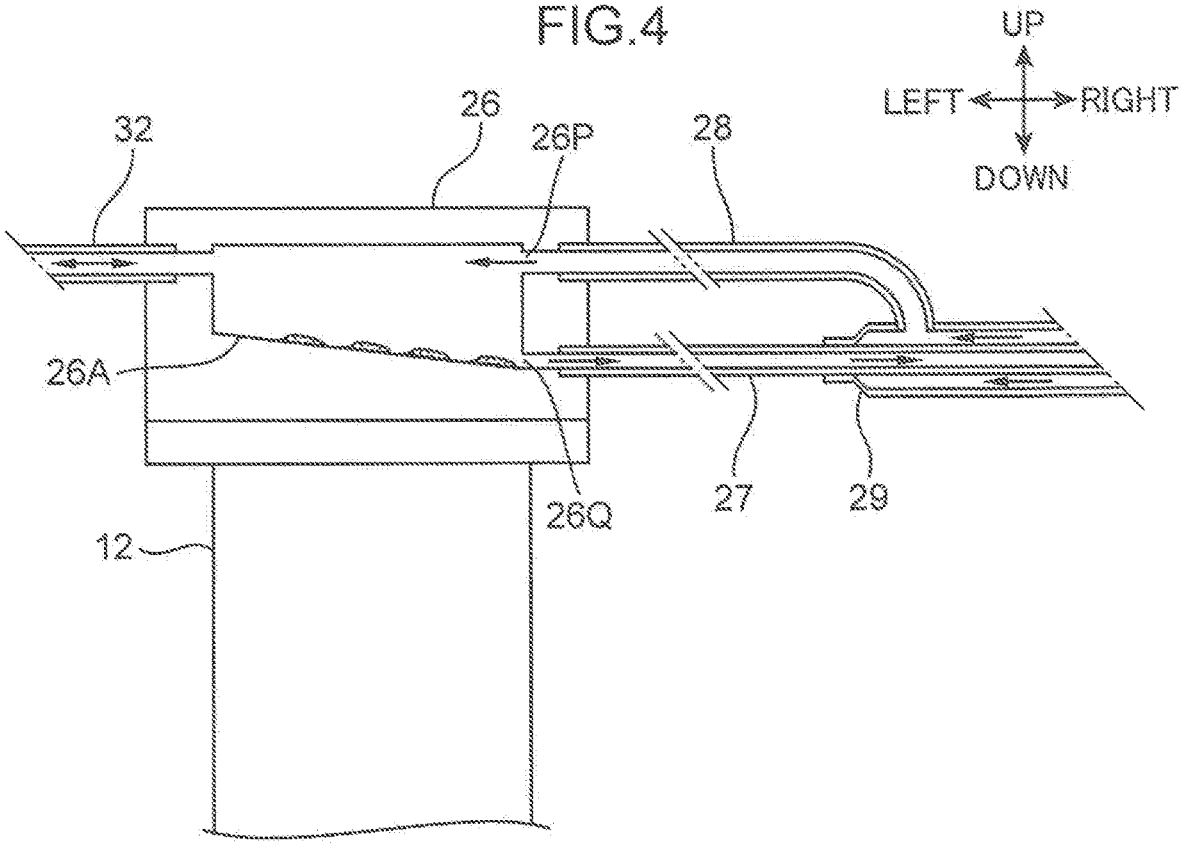
FIG. 4 is an enlarged cross-sectional view of a part of the helium recondensation apparatus for a cryostat according to the embodiment of the present invention.
Figure 5:
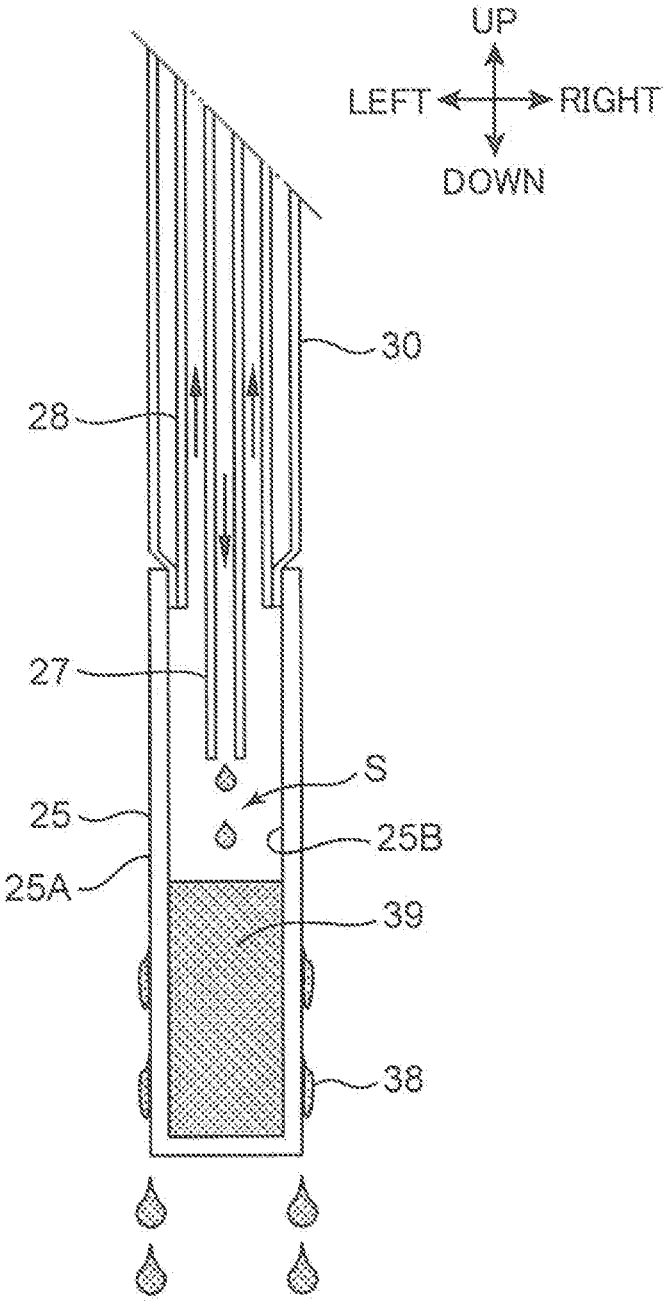
FIG. 5 is an enlarged cross-sectional view of a part of the helium recondensation apparatus for a cryostat according to the embodiment of the present invention.

The helium recondensing unit B (FIG. 2) recondenses the coolant helium in the helium tank 3 by receiving cold energy from the second cooling stage 12 of the freezer 10. The helium recondensing unit B includes: a helium heat exchanger 25 (first heat exchanger); the helium recondensing chamber 26 (first recondensing chamber); a helium backward pipe 27 (first connection part, backward section); a helium forward pipe 28 (first connection part, forward section); a helium forward-backward pipeline header 29; a helium transfer pipe vacuum jacket 30; a helium transfer pipe flexible section 31; a helium supply pipe 32; a helium buffer tank 33; a helium supply valve 34; a helium buffer tank pressure gauge 35; and a helium recondensing chamber heater 36. The respective components of the helium recondensing unit B sequentially correspond to the respective components of the nitrogen recondensing unit A. The nitrogen recondensing unit A has a structure similar to that of the helium recondensing unit B. From this perspective, the structure of the helium recondensing unit B will be described in detail below. Each of FIG. 3 to FIG. 5 is an enlarged cross-sectional view of a part of the recondensation apparatus 100 according to the embodiment.

The helium heat exchanger 25 is located above a liquid surface of the helium (coolant helium) in the helium tank 3 (FIG. 1). The helium heat exchanger 25 has a circular pipe shape with an outer circumferential surface 25A (first outer peripheral surface) and an inner circumferential surface 25B (first inner peripheral surface) (FIG. 5). The inner circumferential surface 25B defines an inner space S (first inner space) separated from the helium in the helium tank 3. The inner space S can store liquid helium (heat-exchanging helium in liquid). The helium heat exchanger 25 takes heat of vaporization, which is necessary for evaporation of the heat-exchanging helium in the inner space S, from the vapor of the coolant helium in the helium tank 3, thereby permitting the coolant helium to recondense through the heat exchange with the heat-exchanging helium in the inner space S. In other words, the helium heat exchanger 25 is exposed in the helium tank 3 of the NMR apparatus 1S to cool and liquefy helium gas around the helium heat exchanger 25 via a pipe wall (outer circumferential surface) of the helium heat exchanger 25, thereby generating heat exchanger outer wall liquid helium 38.

The helium recondensing chamber 26 is located away from the NMR apparatus 1S and has a cylindrical shape, but is thermally connected to a top surface of the second cooling stage 12 of the freezer 10. The helium recondensing chamber 26 is filled with helium gas (heat-exchanging helium), and is cooled by the second cooling stage 12 of the freezer 10 to liquefy the helium in the helium recondensing chamber 26. In this manner, the helium recondensing chamber 26 receives vapor of the helium (gaseous heat-exchanging helium) in the inner space S of the helium heat exchanger 25, recondenses and liquefies the received helium by receiving the cold energy from the second cooling stage 12, and discharges the recondensed and liquified helium.

The helium backward pipe 27 is connected to a lower portion of a side surface of the helium recondensing chamber 26. The liquid helium generated in the helium recondensing chamber 26 is discharged from the helium recondensing chamber 26 through the helium backward pipe 27. The helium backward pipe 27 has a distal end opening to the inner space S of the helium heat exchanger 25, and the liquid helium having flowed out of the helium recondensing chamber 26 drops in the helium heat exchanger 25.

Heat exchanger-inside liquid helium 39 contained in the helium heat exchanger 25 evaporates by heat having entered via the pipe wall of the helium heat exchanger 25 and finally refluxes to an upper portion of the helium recondensing chamber 26 through the helium forward pipe 28. The heat exchanger-inside liquid helium 39 having refluxed is reliquefied in the helium recondensing chamber 26 and is resend to the helium heat exchanger 25 through the helium backward pipe 27. The helium forward-backward pipeline header 29 is mounted to the recondensation apparatus vacuum tank 37 for holding the helium backward pipe 27 and the helium forward pipe 28 so that each of the helium backward pipe 27 and the helium forward pipe 28 is at a fixed position to the helium recondensing chamber 26.

The helium heat exchanger 25 serves to execute the heat exchange inside and outside the pipe wall, and therefore the helium heat exchanger 25 has an internal temperature which is lower than an external temperature of the helium heat exchanger 25. For instance, the internal temperature of the helium heat exchanger 25 is 4.0 K, and the external temperature of the helium heat exchanger 25 (temperature of the helium tank 3) is 4.2 K. Therefore, the helium heat exchanger 25, the helium recondensing chamber 26, the helium backward pipe 27, and the helium forward pipe 28 define an enclosed space having an internal pressure appropriately regulated, normally, to a pressure slightly lower than the atmospheric pressure. In the embodiment, the helium buffer tank 33 has this pressure regulating operability. The helium buffer tank 33 is arranged outside the freezer 10 at a room temperature and connected to the helium recondensing chamber 26 via the helium supply pipe 32.

Furthermore, the helium backward pipe 27 and the helium forward pipe 28 form a first connection part in the embodiment. The first connection part defines a flow passage for permitting the heat-exchanging helium to flow between the helium heat exchanger 25 and the helium recondensing chamber 26. Each of the helium backward pipe 27 and the helium forward pipe 28 connects the inner space S of the helium heat exchanger 25 and the helium recondensing chamber 26 to each other for inhibiting the helium in the helium tank 3 from flowing out to the helium backward pipe 27 and the helium forward pipe 28, permitting the vapor of the helium in the inner space S of the helium heat exchanger 25 to flow into the helium recondensing chamber 26, and further permitting the helium recondensed in the helium recondensing chamber 26 to flow into the inner space S of the helium heat exchanger 25.

As shown in FIG. 4, the helium backward pipe 27 and the helium forward pipe 28 are independent of each other. In particular, the helium forward pipe 28 (forward section) connects the inner space S of the helium heat exchanger 25 and the helium recondensing chamber 26 to each other for permitting the vapor of the helium in the inner space S to flow into the helium recondensing chamber 26. The helium backward pipe 27 (backward section) is independent of the helium forward pipe 28, and connects the inner space S of the helium heat exchanger 25 and the helium recondensing chamber 26 to each other for permitting the helium recondensed in the helium recondensing chamber 26 to flow into the inner space S. As shown in FIG. 4, the helium recondensing chamber 26 has an inlet connection port 26P opening for permitting the heat-exchanging helium to flow into the helium recondensing chamber 26 from the helium forward pipe 28, and an outlet connection port 26Q located below the inlet connection port 26P and opening for permitting the heat-exchanging helium to flow out to the helium backward pipe 27 from the helium recondensing chamber 26. The helium recondensing chamber 26 has a lower surface 26A (first lower surface) whose radially outer portion is at a lower position than its radially inner portion such that the lower surface slants downward to the helium backward pipe 27, and thus results in having a structure where the recondensed liquid helium easily flows out to the helium backward pipe 27.

For instance, the enclosed space (low temperature space) defined by the helium heat exchanger 25, the helium recondensing chamber 26, the helium backward pipe 27, and the helium forward pipe 28 has a total capacity of around 100 cc. Furthermore, an amount of liquid helium existing in the enclosed space is 10 to 20 cc, and an amount of saturated gas helium existing in the enclosed space is 80 to 90 cc. When the temperature of the enclosed space reaches the room temperature in a tightly closed state, a volume expansion occurs due to the change in the temperature. As a result, the gas volume reaches 22 L by standard-state conversion. However, when the enclosed space has the limited capacity of 100 cc, the internal pressure thereof reaches 220 atm. In the embodiment, the recondensation apparatus 100 includes the helium buffer tank 33 to increase the capacity of the enclosed space. The helium buffer tank 33 is connected to the helium recondensing chamber 26 via the helium supply pipe 32 and can pass and receive the helium to and from the helium recondensing chamber 26. The helium buffer tank 33 has a capacity which is larger than a sum of a capacity of the helium recondensing chamber 26 and a capacity of the inner space S of the helium heat exchanger 25. For instance, when the helium buffer tank 33 has the capacity of 8 L, the pressure in this configuration including the enclosed space at the room temperature reaches around 2.8 atm. In other words, initially filling a system including the helium buffer tank 33 in addition to the enclosed space with the helium gas of around 2.8 atm at the room temperature can ensure a necessary amount of each of the liquid helium and the saturated helium gas for a steady operation after a cooling operation. The helium buffer tank 33 receives a supply of the helium from an unillustrated helium tank through the helium supply valve 34. The helium supply valve 34 is closed when the helium buffer tank 33 receives the supply of a predetermined amount of the helium thereinto. The helium buffer tank pressure gauge 35 detects a pressure of the helium in the helium buffer tank 33.

As shown in FIG. 2, the helium (coolant) flowing between the helium recondensing chamber 26 and the helium heat exchanger 25 has a very low temperature, and hence the whole system, except for the helium heat exchanger 25, needs to be vacuum-insulated. For the vacuum insulation, in the embodiment, the helium recondensing chamber 26 is thermally insulated therearound by the recondensation apparatus vacuum tank 37 as described above, and a pipeline part (including the helium backward pipe 27 and the helium forward pipe 28) extending from the helium recondensing chamber 26 to the helium heat exchanger 25 is covered with the helium transfer pipe vacuum jacket 30 and thus is thermally insulated.

It is seen from FIG. 3 to FIG. 5 that the helium transfer pipe vacuum jacket 30 is provided with: a vacuum wall for thermally insulating the helium backward pipe 27 and the helium forward pipe 28 between the helium forward-backward pipeline header 29 and the helium heat exchanger 25; and a radiation shield layer (including a first transfer pipe radiation shield 41, a second transfer pipe radiation shield 42, and a third transfer pipe radiation shield 43) to increase the radiation reduction effect. Consequently, at maximum, a quadruple concentric pipe structure having the helium backward pipe 27 at the center thereof extends from the helium forward-backward pipeline header 29 to the helium heat exchanger 25.

Furthermore, a part of each of the helium backward pipe 27 and the helium forward pipe 28 is formed with the helium transfer pipe flexible section 31 for reducing propagation of mechanical vibration of the freezer 10 and easily inserting the helium heat exchanger 25 into the helium port 4 of the NMR apparatus 1S. The helium transfer pipe flexible section 31 (first flexible section) is arranged at least between the helium heat exchanger 25 and the helium recondensing chamber 26, has flexibility (is made of flexible member), is deformable to be suitable for a peripheral structure, and is configured to suppress the propagation of the vibration of the freezer 10 to the NMR apparatus 1S through the pipeline part (first connection part) extending from the helium recondensing chamber 26 to the helium heat exchanger 25.

The helium recondensing chamber heater 36 (FIG. 2) is mounted on the top surface of the helium recondensing chamber 26, and generates heat in response to an input signal from an unillustrated controller. A pressure of the helium tank 3 is constantly maintained by regulating an output (generated heat amount) from the helium recondensing chamber heater 36 in correspondence to the internal pressure of the helium tank 3 as detected by the helium tank pressure gauge 47.

As shown in FIG. 1 and FIG. 2, the nitrogen recondensing unit A has the structure similar to the structure of the helium recondensing unit B, but the nitrogen recondensing unit A will be described below mainly for differences seen therebetween.

The nitrogen tank 7 included in the NMR apparatus 1S has a cylindrical shape surrounding the helium tank 3 to store the liquid nitrogen 6 (a thermally-insulating auxiliary coolant in liquid, thermally-insulating nitrogen in liquid). The nitrogen heat exchanger 13 (second heat exchanger) included in the nitrogen recondensing unit A of the recondensation apparatus 100 is located above a liquid surface of the liquid nitrogen 6 in the nitrogen tank 7. The nitrogen heat exchanger 13 has, in the same manner as the helium heat exchanger 25, an outer circumferential surface (second outer peripheral surface), and an inner circumferential surface (second inner peripheral surface) defining an inner space (second inner space) separated from the nitrogen in the nitrogen tank 7 for storing liquid nitrogen (heat-exchanging auxiliary coolant in liquid, heat-exchanging nitrogen in liquid). The nitrogen heat exchanger 13 takes heat of vaporization, which is necessary for evaporation of the liquid nitrogen in the second inner space, from vapor of the thermally-insulating nitrogen in the nitrogen tank 7, thereby permitting thermally-insulating nitrogen to recondense through the heat exchange with the heat-exchanging nitrogen in the second inner space. The above-described operative action is same as the operative action of the helium heat exchanger 25 in the helium tank 3.

In the same manner as the helium recondensing chamber 26, the nitrogen recondensing chamber 14 is located away from the NMR apparatus IS but in thermally contact with the first cooling stage 11, and configured to receive vapor of nitrogen gas (a gaseous heat-exchanging auxiliary coolant) in the second inner space, recondense and liquefy the received nitrogen gas by receiving the cold energy from the first cooling stage 11, and discharge the recondensed and liquefied nitrogen to the nitrogen heat exchanger 13. Transfer of the nitrogen between the nitrogen heat exchanger 13 and the nitrogen recondensing chamber 14 is executed through the nitrogen backward pipe 15 and the nitrogen forward pipe 16. The nitrogen backward pipe 15 and the nitrogen forward pipe 16 form a second connection part in the embodiment. The second connection part defines a flow passage for permitting the heat-exchanging nitrogen to flow between the nitrogen heat exchanger 13 and the nitrogen recondensing chamber 14, and connects the second inner space of the nitrogen heat exchanger 13 and the nitrogen recondensing chamber 14 to each other for inhibiting the nitrogen in the nitrogen tank 7 from flowing out to the nitrogen backward pipe 15 and the nitrogen forward pipe 16, and permitting the vapor of the nitrogen in the second inner space to flow into the nitrogen recondensing chamber 14, and further permitting the nitrogen recondensed in the nitrogen recondensing chamber 14 to flow into the second inner space. A pipeline part (including the nitrogen backward pipe 15 and the nitrogen forward pipe 16) extending from the nitrogen recondensing chamber 14 to the nitrogen heat exchanger 13 is covered with the nitrogen transfer pipe vacuum jacket 18 and is thus thermally insulated. The nitrogen transfer pipe vacuum jacket 18 (second flexible section) also has the nitrogen transfer pipe flexible section 19 (second flexible section) arranged at least between the nitrogen heat exchanger 13 and the nitrogen recondensing chamber 14 and having flexibility (made of flexible member), and thus is deformable to be suitable for a peripheral structure, and suppresses the propagation of the vibration of the freezer 10 to the NMR apparatus 1S through the pipeline part (second connection part) extending from the nitrogen recondensing chamber 14 to the nitrogen heat exchanger 13.

As shown in FIG. 2, the nitrogen recondensing chamber 14 surrounds the first cooling stage 11 having the cylindrical shape. In other words, the nitrogen recondensing chamber 14 has a cylindrical inner space for recondensing the nitrogen. The nitrogen recondensing chamber 14 has a lower surface (second lower surface), like the lower surface 26A of the helium recondensing chamber 26, whose radially outer portion is at a lower position than its radially inner portion such that the lower surface slants downward to the nitrogen backward pipe 15, and thus results in having a structure where the recondensed liquid nitrogen easily flows out to the nitrogen backward pipe 15.

Next, the arrangement of the NMR apparatus IS and the recondensation apparatus 100 will be further described with reference to FIG. 1. In the embodiment, the housing 100S is adjacent to the NMR apparatus 1S on the floor surface. The housing 100S supports the helium recondensing chamber 26 and the nitrogen recondensing chamber 14 so that the helium recondensing chamber 26 is at a higher position than the helium tank 3 and that the nitrogen recondensing chamber 14 is at a higher position than the nitrogen tank 7. The housing 100S further operably supports the freezer 10 including the first cooling stage 11 and the second cooling stage 12. The housing 100S additionally supports the nitrogen buffer tank 21 and the helium buffer tank 33 below the freezer 10. Here, the nitrogen buffer tank 21 and the helium buffer tank 33 may be independent of the housing 100S.

The NMR apparatus 1S has the aforementioned helium port 4 (inlet port) communicating with the upper end of the helium tank 3 for permitting the helium heat exchanger 25 to be inserted into the helium tank 3 from above. The housing 100S supports the helium recondensing chamber 26 so that the helium recondensing chamber 26 deviates horizontally (leftward) from the helium port 4 of the helium tank 3 above the helium port 4 (FIG. 1).

Furthermore, the helium transfer pipe vacuum jacket 30 including the helium backward pipe 27 and the helium forward pipe 28 continuously extends downward from the helium recondensing chamber 26 to the helium heat exchanger 25 for permitting the liquid helium discharged from the helium recondensing chamber 26 to flow into the inner space S of the helium heat exchanger 25 by gravity. More specifically, the helium transfer pipe vacuum jacket 30 has a tilting section 30A tilting downward from the helium recondensing chamber 26 as approaching the helium port 4 (neck tube) and a vertical section 30B vertically extending from a distal end of the tilting section 30A to the inner space S through the helium port 4. Similarly, the nitrogen transfer pipe vacuum jacket 18 including the nitrogen backward pipe 15 and the nitrogen forward pipe 16 extends downward (continuously downward) from the nitrogen recondensing chamber 14 to the nitrogen heat exchanger 13 for permitting the recondensed liquid nitrogen to flow by gravity. The term "continuously downward" covers a state of the pipeline partly curving or bending.

This configuration can suppress an increase in the height of the topmost portion of the recondensation apparatus 100 more effectively than a configuration where each of the freezer 10, the nitrogen recondensing chamber 14, and the helium recondensing chamber 26 are located right above the NMR apparatus 1S, and thus leads to a successful arrangement of the NMR apparatus 1S and the recondensation apparatus 100 even in an environment having a ceiling C with a height restriction.

In the embodiment, as shown in FIG. 2, the motor M of the freezer 10 is located below the cylinder 10P, that is, the freezer 10 is invertedly arranged. Specifically, the first cooling stage 11 is connected to the cylinder 10P above the motor M for cooling the nitrogen recondensing chamber 14 by receiving cold energy, and the second cooling stage 12 is connected to the cylinder 10P above the first cooling stage 11 for cooling the helium recondensing chamber 26 at a lower temperature than a temperature of the nitrogen recondensing chamber 14 by receiving cold energy. As a result, each of the first cooling stage 11 and the second cooling stage 12 of the freezer 10 is arrangeable at a higher position than the motor M to thereby easily give a height difference therebetween for permitting the liquid helium to flow downward from the helium recondensing chamber 26 and permitting the liquid nitrogen to flow downward from the nitrogen recondensing chamber 14.

As described above, in the embodiment, the coolant helium is allowed to recondense in the helium tank 3 by receiving the cold energy given from the freezer 10 in response to the flow, accompanied by the condensation and the evaporation, of the heat-exchanging helium separated from the coolant helium. This can prevent the helium backward pipe 27 and the helium forward pipe 28 from being clogged in their respective flow passages in spite of entering of any air component of the coolant helium. More specifically, when the coolant helium evaporates in the helium tank 3 of the NMR apparatus 1S, the helium heat exchanger 25 takes heat from the coolant helium, thereby permitting the coolant helium to recondense and liquefy. The helium heat exchanger 25 is arranged in the helium tank 3, and thus the coolant helium recondensed by a contact with the helium heat exchanger 25 is directly storable in the helium tank 3. The helium recondensing chamber 26 is cooled by the second cooling stage 12 of the freezer 10 and thus can recondense the vapor of the heat-exchanging helium having evaporated owing to the heat taken from the coolant helium. Moreover, each of the helium backward pipe 27 and the helium forward pipe 28 connects the helium heat exchanger 25 separated from the coolant helium in the helium tank 3 and the helium recondensing chamber 26 located outside the NMR apparatus 1S to each other for circulating the heat-exchanging helium while preventing the coolant helium in the helium tank 3 to flow out of the NMR apparatus 1S. This configuration never allows the air component existing in the helium tank 3 to pass through the helium backward pipe 27 and the helium forward pipe 28, and thus can prevent the air component from freezing in the flow passage defined by the helium backward pipe 27 and the helium forward pipe 28 and clogging the flow passage. The frequency of the work of replenishing the helium heat exchanger 25 and the helium recondensing chamber 26 with the heat-exchanging helium is smaller than the frequency of the work of replenishing the helium tank 3 with the liquid helium, and further the relevant volume for the replenishment of the heat-exchanging helium is also smaller than that for the replenishment of the liquid helium. Accordingly, the replenishing work is executable while easily preventing entering of the air component.

As described above, the helium heat exchanger 25 stores another liquid helium which is different from the liquid helium in the helium tank 3 and utilizes heat of vaporization taken from the vapor of the different liquid helium, thereby recondensing vapor of the helium in the helium tank 3. This eliminates the necessity of providing an unillustrated pump for forcibly circulating the heat-exchanging helium between the helium heat exchanger 25 and the helium recondensing chamber 26.

Moreover, in the embodiment, the vapor of the heat-exchanging helium and the recondensed heat-exchanging helium can flow respectively through the helium forward pipe 28 and the helium backward pipe 27 independent of each other. This configuration can prevent the liquid helium from impeding the flow of the gaseous helium more effectively and maintain the flows of the heat-exchanging helium in the two states more stably than a configuration where the liquid helium and the gaseous helium flow in the same connection part.

In the embodiment, the outlet connection port 26Q is located below the inlet connection port 26P in the helium recondensing chamber 26. This arrangement can prevent the recondensed heat-exchanging helium from clogging the inlet connection port 26P so as not to block an inflow of the vapor of the heat-exchanging helium into the helium recondensing chamber 26.

Furthermore, in the embodiment, the housing 100S supports the helium recondensing chamber 26, and the helium transfer pipe vacuum jacket 30 continuously extends downward from the helium recondensing chamber 26 to the helium heat exchanger 25. This arrangement permits the heat-exchanging helium recondensed in the helium recondensing chamber 26 to stably flow into the inner space S of the helium heat exchanger 25.

In the embodiment, the helium buffer tank 33 connected to the helium recondensing chamber 26 can increase the capacity for accommodating the heat-exchanging helium. This configuration can decrease the pressure at the replenishment of the heat-exchanging helium necessary for the recondensation of the coolant helium to each of the helium heat exchanger 25 and the helium recondensing chamber 26 more effectively than a configuration having no helium buffer tank 33.

In the embodiment, when the thermally-insulating nitrogen evaporates in the nitrogen tank 7 of the NMR apparatus 1S, the nitrogen heat exchanger 13 takes heat from the vapor of the thermally-insulating nitrogen, thereby permitting the thermally-insulating nitrogen to recondense. This can consequently prevent the thermally-insulating nitrogen in the nitrogen tank 7 included in the NMR apparatus 1S from evaporating and reducing, and thus can further stably cool the helium tank 3. Additionally, this configuration never allows the air component existing in the nitrogen tank 7 to pass through the nitrogen backward pipe 15 and the nitrogen forward pipe 16, and thus can prevent the air component from freezing in the flow passage defined by the nitrogen backward pipe 15 and the nitrogen forward pipe 16 and clogging the flow passage.

In the embodiment, the freezer 10 of two-stage type including the first cooling stage 11 and the second cooling stage 12 is used to thereby succeed in stable recondensation of each of the helium and the nitrogen in the NMR apparatus IS. Besides, the freezer 10 has the motor M located below the cylinder 10P, and thus each of the first cooling stage 11 and the second cooling stage 12 is arrangeable at a higher position than the motor M. This configuration can suppress an increase in the height of the topmost portion of the recondensation apparatus 100 in the location thereof, and further permits the liquid helium discharged from the helium recondensing chamber 26 to flow into the helium heat exchanger 25 and permits the liquid nitrogen discharged from the nitrogen recondensing chamber 14 to flow into the nitrogen heat exchanger 13 by gravity more effectively than a configuration where the motor M is located above the cylinder 10P.

The recondensation apparatus 100 (helium recondensation apparatus for a cryostat) according to the embodiment of the present invention is described heretofore, but the present invention is not limited thereto, and can cover the following modified embodiments.

Figure 6:
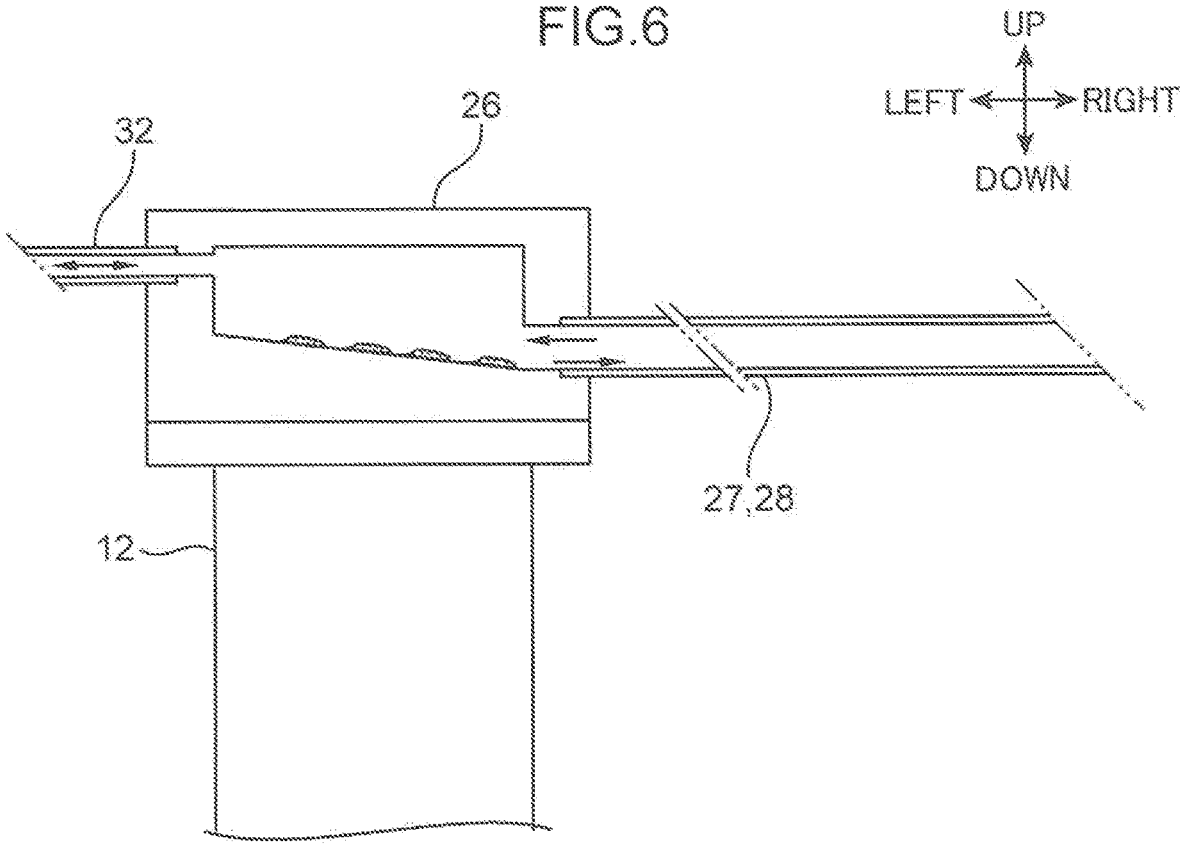
FIG. 6 is an enlarged cross-sectional view of a part of a helium recondensation apparatus for a cryostat according to a first modified embodiment of the present invention.
Figure 7:
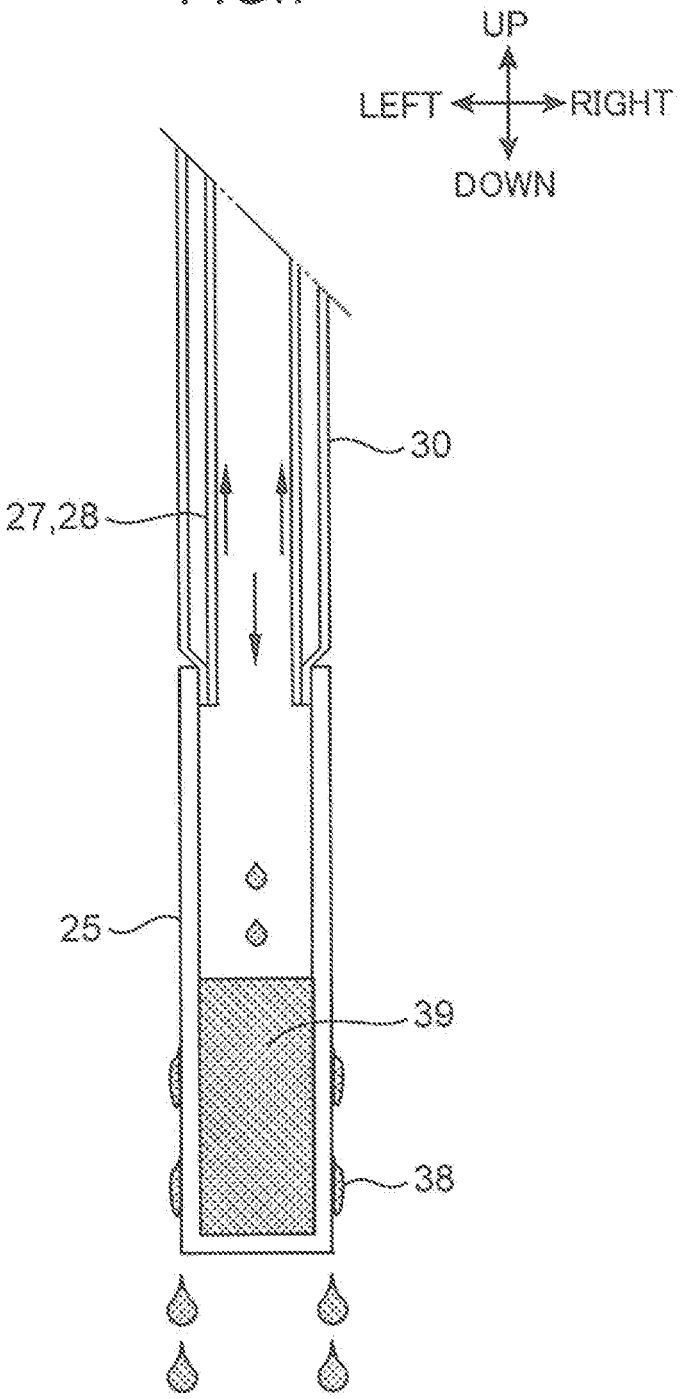
FIG. 7 is an enlarged cross-sectional view of a part of the helium recondensation apparatus for a cryostat according to the first modified embodiment of the present invention.

(1) Although the helium heat exchanger 25 and the helium recondensing chamber 26 connected to each other via the helium backward pipe 27 and the helium forward pipe 28 in the form of the double-pipe structure is described in the embodiment, the present invention is not limited thereto. FIG. 6 is an enlarged cross-sectional view of a part (helium recondensing chamber 26) of a recondensation apparatus 100 (helium recondensation apparatus for a cryostat) according to a first modified embodiment of the present invention. FIG. 7 is an enlarged cross-sectional view of a part (helium heat exchanger 25) of the recondensation apparatus 100 according to the modified embodiment.

The pipeline for the helium forward pipe 28 and the helium backward pipe 27 in the form of the double-pipe structure as in the forward embodiment has a large diameter, and hence the helium port 4 needs a predetermined opening dimension. In contrast, in this modified embodiment, as shown in FIG. 6 and FIG. 7, a helium backward pipe 27 and a helium forward pipe 28 are not independent of each other, but integrate into a single pipeline. Specifically, in the modified embodiment, the helium forward pipe 28 and the helium backward pipe 27 integrate into the single pipeline connecting an inner space S of a helium heat exchanger 25 and a helium recondensing chamber 26 to each other for permitting vapor of heat-exchanging helium in the inner space S to flow into the helium recondensing chamber 26 and permitting the heat-exchanging helium recondensed in the helium recondensing chamber 26 to flow into the inner space S. This configuration can simplify the pipeline structure for connecting the helium heat exchanger 25 and the helium recondensing chamber 26 to each other. As shown in FIG. 6, the liquid helium generated in the helium recondensing chamber 26 is sent to the helium heat exchanger 25 through a lower portion of the single pipeline. In contrast, the vapor of the helium in the helium heat exchanger 25 flows into the helium recondensing chamber 26 through an upper portion of the single pipeline.

(2) Although an aspect where the recondensation apparatus 100 has the helium buffer tank 33 for supplying the helium under a predetermined pressure in connecting the recondensation apparatus 100 to the NMR apparatus 1S is described in the forward embodiment, the present invention is not limited thereto. The recondensation apparatus 100 may additionally include another tank.

Figure 8:
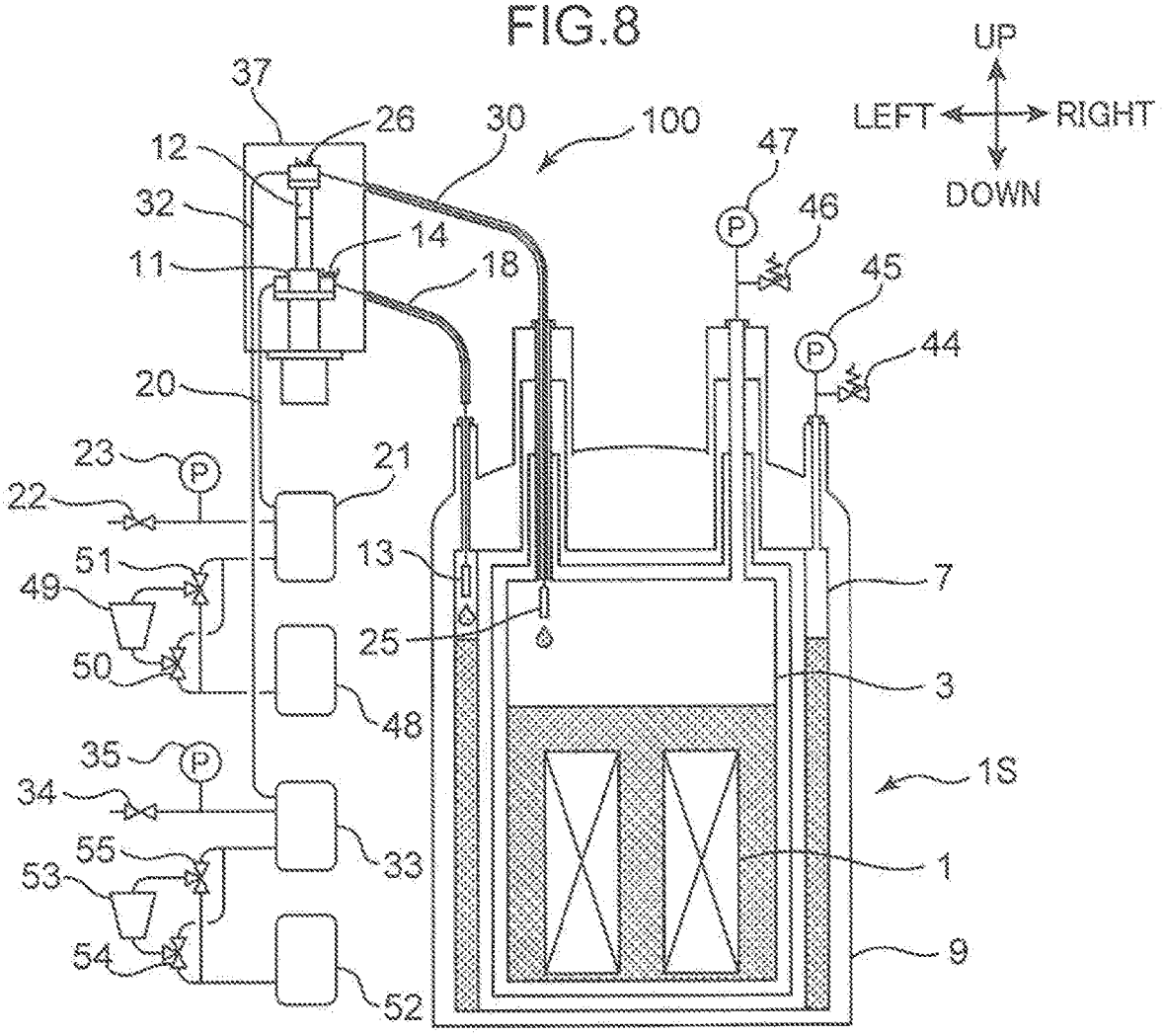
FIG. 8 is a cross-sectional view showing a state where a helium recondensation apparatus for a cryostat according to a second modified embodiment of the present invention is connected to an NMR apparatus.

FIG. 8 is a cross-sectional view showing a state where a recondensation apparatus 100 (helium recondensation apparatus for a cryostat) according to a second modified embodiment of the present invention is connected to an NMR apparatus 1S. In this modified embodiment, differences from the forward embodiment (FIG. 1) will be mainly described (hereinafter, the same description way is applied to the subsequent modified embodiments to be described later). As shown in FIG. 8, the recondensation apparatus 100 further includes a nitrogen reservoir tank 48, a nitrogen pump 49, a nitrogen pump discharge three-way switch valve 50, and a nitrogen pump intake three-way switch valve 51 each constituting a part of a nitrogen recondensing unit A, and includes a helium reservoir tank 52, a helium pump 53 arranged between a helium buffer tank 33 and the helium reservoir tank 52, a helium pump discharge three-way switch valve 54, and a helium pump intake three-way switch valve 55 each constituting a part of a helium recondensing unit B. Hereinafter, the structure of the helium recondensing unit B in this modified embodiment will be exemplarily described.

The helium reservoir tank 52 is independent of a helium recondensing chamber 26, and is connected to the helium buffer tank 33 via the helium pump 53. As a result, the helium reservoir tank 52 and the helium buffer tank 33 can supply and pass helium (heat-exchanging helium) therebetween. Besides, the helium pump discharge three-way switch valve 54 (discharge-side switch valve) is disposed between the helium buffer tank 33 and the helium pump 53, and the helium pump intake three-way switch valve 55 (intake-side switch valve) is disposed between the helium reservoir tank 52 and the helium pump 53. The helium pump intake three-way switch valve 55 is disposed on an intake side of the helium pump 53 for switching a supply source of supplying heat-exchanging helium to the helium pump 53 between the helium buffer tank 33 and the helium reservoir tank 52. The helium pump discharge three-way switch valve 54 is disposed on a discharge side of the helium pump 53 for switching a discharge destination to which the heat-exchanging helium is discharged from the helium pump 53 between the helium buffer tank 33 and the helium reservoir tank 52. The helium pump discharge three-way switch valve 54 and the helium pump intake three-way switch valve 55 respectively change the supply source of the helium for the helium pump 53 and the discharge destination of the helium from the helium pump 53 between the helium buffer tank 33 and the helium reservoir tank 52 in response to an instruction signal from an unillustrated controller. The helium pump 53, the helium pump discharge three-way switch valve 54, and the helium pump intake three-way switch valve 55 form a pressure regulation mechanism of the present invention. The pressure regulation mechanism regulates a transfer amount of the heat-exchanging helium between the helium buffer tank 33 and the helium reservoir tank 52 so that a pressure of the helium buffer tank 33 falls within a predetermined range.

In a case where the pressure of the helium buffer tank 33 detected by a helium buffer tank pressure gauge 35 is higher than a predetermined pressure (deviates from an appropriate range) after the recondensation apparatus 100 shifts to a steady operation in the same manner as in the forward embodiment, an unillustrated controller controls the helium pump discharge three-way switch valve 54 and the helium pump intake three-way switch valve 55 for switching so that the intake side of the helium pump 53 is connected to the helium buffer tank 33 and the discharge side of the helium pump 53 is connected to the helium reservoir tank 52. As a result, the helium reservoir tank 52 is replenished with the helium from the helium buffer tank 33 and the helium buffer tank 33 is regulated to a redetermined pressure. Conversely, in a case where the pressure of the helium buffer tank 33 detected by the helium buffer tank pressure gauge 35 is lower than the predetermined pressure, the helium pump discharge three-way switch valve 54 and the helium pump intake three-way switch valve 55 are switched so that the intake side of the helium pump 53 is connected to the helium reservoir tank 52 and the discharge side of the helium pump 53 is connected to the helium buffer tank 33. As a result, the helium is discharged from the helium reservoir tank 52 to the helium buffer tank 33, and the helium buffer tank 33 is regulated to the predetermined pressure. Completion of the regulation of the pressure may be determined depending on the pressure of the helium buffer tank 33 detected by the helium buffer tank pressure gauge 35. Similarly, in the nitrogen recondensing unit A, the nitrogen pump discharge three-way switch valve 50 and the nitrogen pump intake three-way switch valve 51 can switch a discharge destination from the nitrogen pump 49 between the nitrogen buffer tank 21 and the nitrogen reservoir tank 48, and a pressure of the nitrogen buffer tank 21 detected by a nitrogen buffer tank pressure gauge 23 is set to fall within an appropriate range.

Even when a pressure in each of a nitrogen heat exchanger 13 and a helium heat exchanger 25 changes depending on the characteristics (thermal-insulation capability), an operation state (room temperature, room pressure), a change in the operation state (power outage) of the NMR apparatus 1S, or individuality (freezing capability) and maintenance condition (replacement) of a freezer 10, this configuration can automatically regulate the pressure and stably maintain the recondensation of each of the nitrogen and the helium.

Figure 9:
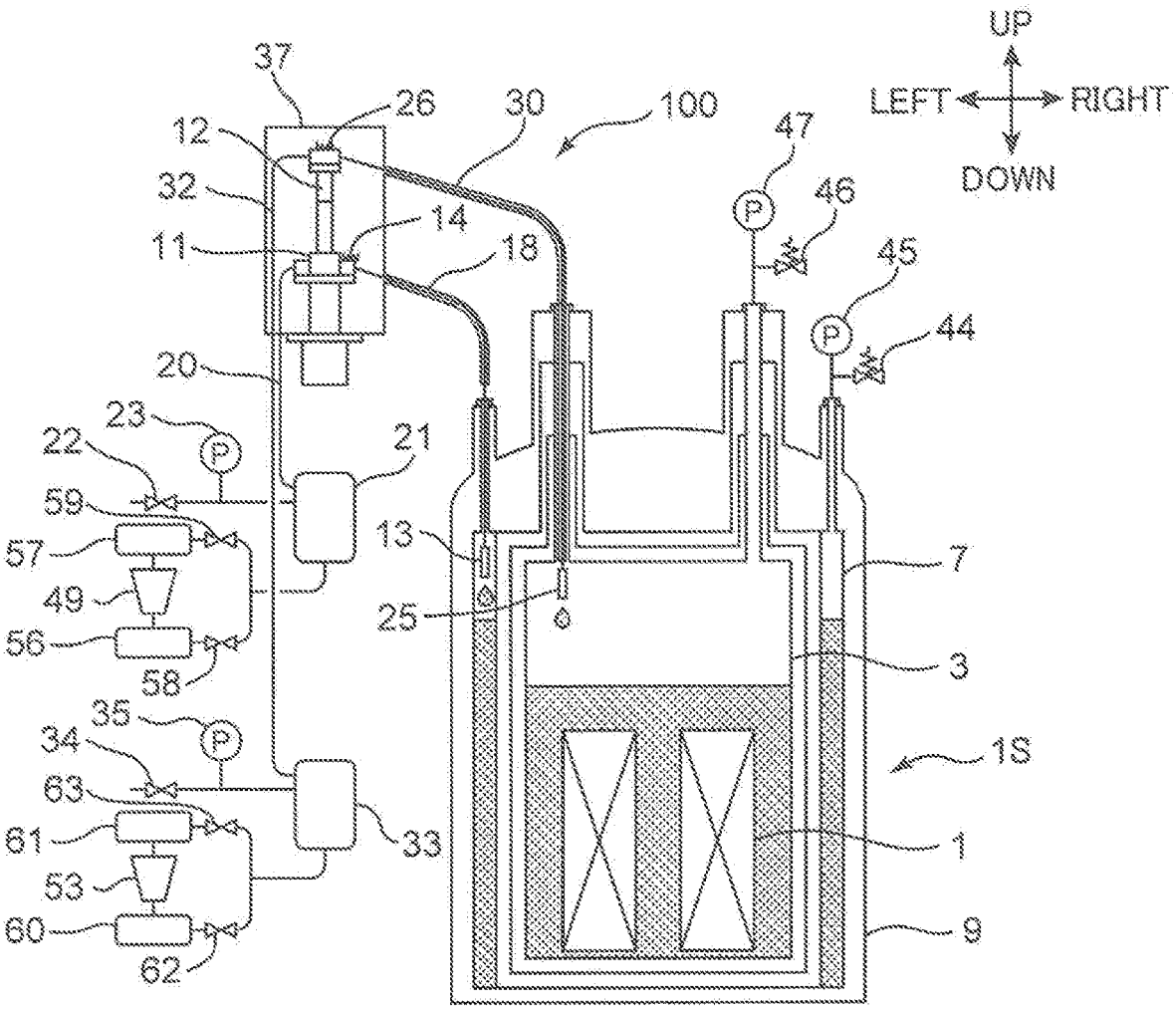
FIG. 9 is a cross-sectional view showing a state where a helium recondensation apparatus for a cryostat according to a third modified embodiment of the present invention is connected to an NMR apparatus.

FIG. 9 is a cross-sectional view showing a state where a recondensation apparatus 100 (helium recondensation apparatus for a cryostat) according to a third modified embodiment of the present invention is connected to an NMR apparatus 1S. In the modified embodiment, two reservoir tanks, i.e., a helium high-pressure reservoir tank 60 (high-pressure reservoir tank part) and a helium low-pressure reservoir tank 61 (low-pressure reservoir tank part), are connected to a helium buffer tank 33 in parallel to each other. The helium low-pressure reservoir tank 61 has a lower pressure than the helium buffer tank 33, and the pressure is set to a value equal to or lower than the atmospheric pressure. In contrast, the helium high-pressure reservoir tank 60 has a higher pressure than the helium buffer tank 33, and the pressure is set to a value equal to or higher than the atmospheric pressure. A helium pump 53 is arranged between the helium high-pressure reservoir tank 60 and the helium low-pressure reservoir tank 61. A helium low-pressure valve 63 is disposed between the helium pump 53 and the helium low-pressure reservoir tank 61, and openable to permit heat-exchanging helium to flow out to the helium low-pressure reservoir tank 61 from the helium buffer tank 33 in response to an operation of the helium pump 53. A helium high-pressure valve 62 is disposed between the helium pump 53 and the helium high-pressure reservoir tank 60, and openable to permit the heat-exchanging helium to flow into the helium buffer tank 33 from the helium high-pressure reservoir tank 60 in response to an operation of the helium pump 53. In this manner, the helium high-pressure valve 62 opens in an operation state of the helium pump 53 to supply the helium from the helium high-pressure reservoir tank 60 to the helium buffer tank 33. In contrast, the helium low-pressure valve 63 opens to discharge the helium from the helium buffer tank 33 to the helium low-pressure reservoir tank 61. As described above, an unillustrated controller controls the helium high-pressure valve 62 or the helium low-pressure valve 63 in response to a detection result from a helium buffer tank pressure gauge 35 so that a pressure of the helium buffer tank 33 falls within an appropriate range after each of the recondensation apparatus 100 and the NMR apparatus 1S shifts to a steady operation in this modified embodiment as well. Consequently, the modified embodiment can exert the same advantageous effect as the first modified embodiment. In addition to the helium pump 53, the helium high-pressure reservoir tank 60, the helium low-pressure reservoir tank 61, the helium high-pressure valve 62, and the helium low-pressure valve 63 form the pressure regulation mechanism of the present invention. Here, a nitrogen high-pressure reservoir tank 56, a nitrogen low-pressure reservoir tank 57, a nitrogen high-pressure valve 58, and a nitrogen low-pressure reservoir valve 59 also have similar operability.

(3) Although an aspect where the nitrogen tank 7 surrounds the helium tank 3 is described in the embodiment, an argon tank may be arranged in place of the nitrogen tank 7 to suppress entering of the heat into the helium tank 3 by liquid argon. In this case, the argon tank is desirably provided with a heat exchanger similar to the nitrogen heat exchanger 13. Furthermore, in another aspect, the nitrogen heat exchanger 13 may not be arranged in the nitrogen tank 7 under the condition that the helium heat exchanger 25 is arranged in the helium tank 3 to encourage recondensation of the helium in the helium tank 3.

A helium recondensation apparatus for a cryostat according to one aspect of the present invention is a helium recondensation apparatus for a cryostat which includes a helium tank tightly closed to store coolant helium in liquid and accommodates a cooled object immersed in the coolant helium, the apparatus being connectable to the cryostat for recondensing vapor of the coolant helium in the helium tank. The helium recondensation apparatus for a cryostat includes: a freezer located away from the cryostat and including a main cooling part kept at a very low temperature; and a helium recondensing unit which recondenses the coolant helium in the helium tank by receiving cold energy from the main cooling part of the freezer. The helium recondensing unit includes: a first heat exchanger located above a liquid surface of the coolant helium in the helium tank, and having a first inner space separated from the coolant helium in the helium tank for storing heat-exchanging helium in liquid, the first heat exchanger taking heat of vaporization for evaporation of the heat-exchanging helium in the inner space, from the vapor of the coolant helium in the helium tank; a first recondensing chamber located away from the cryostat but in thermally contact with the main cooling part, and configured to receive vapor of the heat-exchanging helium in the first inner space, recondense and liquefy the received vapor of the heat-exchanging helium by receiving the cold energy from the main cooling part, and discharge the recondensed and liquefied heat-exchanging helium; a support mechanism which supports the first recondensing chamber so that the first recondensing chamber is at a higher position than the helium tank; and a first connection part continuously extending downward from the first recondensing chamber to the first heat exchanger located in the cryostat to define a flow passage for permitting the heat-exchanging helium to flow between the first recondensing chamber and the first heat exchanger so that the heat-exchanging helium discharged from the first recondensing chamber flows to the first inner space of the first heat exchanger by gravity.

According to this configuration, the coolant helium is allowed to recondense in the helium tank by receiving the cold energy given from the freezer in response to the flow, accompanied by the condensation and the evaporation, of the heat-exchanging helium separated from the coolant helium. This can prevent the first connection part from being clogged in the flow passage thereof despite entering of any air component of the coolant helium. More specifically, when the coolant helium evaporates in the helium tank of the cryostat, the first heat exchanger takes heat from the coolant helium, thereby permitting the coolant helium to recondense. The first heat exchanger is arranged in the helium tank, and thus the coolant helium recondensed by a contact with the first heat exchanger is directly storable in the helium tank. The first recondensing chamber is cooled by the main cooling part of the freezer and thus can recondense the vapor of the heat-exchanging helium owing to the heat taken from the coolant helium. Moreover, the first connection part connects the first heat exchanger separated from the coolant helium in the helium tank and the first recondensing chamber located outside the cryostat to each other for circulating the heat-exchanging helium while preventing the coolant helium in the helium tank to flow out of the cryostat. In this case, the relative positional relationship between the first recondensing chamber and the first heat exchanger achieves a stable inflow of the heat-exchanging helium recondensed in the first recondensing chamber into the first inner space of the first heat exchanger. This configuration never allows an air component pass through the first connection part even when the air component happens to enter the helium tank at the supply of the liquid helium into the helium tank, and thus can prevent the air component from freezing in a flow passage defined by the first connection part and clogging the flow passage.

In the configuration, the first connection part preferably includes: a forward section which connects the first inner space of the first heat exchanger and the first recondensing chamber to each other for permitting the vapor of the heat-exchanging helium in the first inner space to flow into the first recondensing chamber; and a backward section which is independent of the forward section and connects the first inner space of the first heat exchanger and the first recondensing chamber to each other for permitting the heat-exchanging helium recondensed in the first recondensing chamber to flow into the first inner space.

In this continuation, the vapor of the heat-exchanging helium and the recondensed heat-exchanging helium can flow respectively through the forward section and the backward section independent of each other. This configuration can prevent the liquid helium from impeding the flow of the gaseous helium more effectively and maintain the flows of the heat-exchanging helium in the two states more stably than a configuration where the liquid helium and the gaseous helium flow in the same connection part.

In the configuration, the first recondensing chamber desirably has: an inlet connection port for permitting the heat-exchanging helium to flow into the first recondensing chamber from the forward section; and an outlet connection port located below the inlet connection port for permitting the heat-exchanging helium to flow out to the backward section from the first recondensing chamber.

According to this configuration, the outlet connection port is located below the inlet connection port in the first recondensing chamber. This arrangement can prevent the recondensed heat-exchanging helium from clogging the inlet connection port so as not to block an inflow of the vapor of the heat-exchanging helium into the first recondensing chamber.

In the configuration, the first connection part desirably includes a single pipeline connecting the first inner space of the first heat exchanger and the first recondensing chamber to each other for permitting the vapor of the heat-exchanging helium in the first inner space to flow into the first recondensing chamber, and permitting the heat exchanging helium recondensed in the first recondensing chamber to flow into the first inner space.

This configuration can simplify the pipeline structure for connecting the first heat exchanger and the first recondensing chamber to each other.

In the configuration, the first recondensing chamber desirably has a first lower surface slanting downward to the first connection part.

This configuration achieves a stable inflow of the heat-exchanging helium recondensed in the first recondensing chamber into the first connection part.

In the configuration, the first connection part desirably has a first flexible section made of flexible member and arranged at least between the first heat exchanger and the first recondensing chamber.

This configuration can suppress propagation of the vibration of the freezer to the cryostat through the first connection part.

The configuration desirably further includes a helium buffer tank connected to the first recondensing chamber for transferring the heat-exchanging helium between the helium buffer tank and the first recondensing chamber, and having a capacity which is larger than a sum of a capacity of the first recondensing chamber and a capacity of the first inner space.

This configuration where the helium buffer tank connected to the first recondensing chamber can increase the capacity for storing the heat-exchanging helium can reduce the pressure at the replenishment of the heat-exchanging helium to each of the first recondensing chamber and the first heat exchanger more effectively than a configuration having no helium buffer tank.

The configuration desirably further includes: a helium reservoir tank which is independent of the first recondensing chamber and connected to the helium buffer tank for transferring the heat-exchanging helium between the helium reservoir tank and the helium buffer tank; and a pressure regulation mechanism which regulates a transfer amount of the heat-exchanging helium between the helium buffer tank and the helium reservoir tank so that the pressure in the helium buffer tank falls within a predetermined range.

According to this configuration, the pressure regulation mechanism can regulate the pressure of the helium buffer tank even when the pressure of the heat-exchanging helium fluctuates in use of the cryostat. This consequently achieves stable condensation of the cooling helium in the helium tank.

In the configuration, the pressure regulation mechanism desirably includes: a helium pump arranged between the helium buffer tank and the helium reservoir tank; an intake-side switch valve disposed on an intake side of the helium pump for switching a supply source of supplying the heat-exchanging helium to the helium pump between the helium buffer tank and the helium reservoir tank; and a discharge-side switch valve disposed on a discharge side of the helium pump for changing a discharge destination to which the heat-exchanging helium is discharged between the helium buffer tank and the helium reservoir tank.

Even when the pressure in the first heat exchanger changes depending on the characteristics, an operation state, and a change in the operation state of the cryostat, or individuality and a maintenance condition of the freezer, this configuration can automatically regulate the pressure and stably maintain the recondensation of the heat-exchanging helium.

In the configuration, the helium reservoir tank desirably has: a low-pressure reservoir tank part having a lower pressure than the helium buffer tank; and a high-pressure reservoir tank part having a higher pressure than the helium buffer tank. The pressure regulation mechanism desirably includes: a helium pump arranged between the low-pressure reservoir tank part and the high-pressure reservoir tank part; a helium low-pressure valve disposed between the helium pump and the low-pressure reservoir tank part, and openable to permit the heat-exchanging helium to flow out to the low-pressure reservoir tank part from the helium buffer tank in response to an operation of the helium pump; and a helium high-pressure valve disposed between the helium pump and the high-pressure reservoir tank part, and openable to permit the heat-exchanging helium to flow into the helium buffer tank from the high-pressure reservoir tank part in response to an operation of the helium pump.

Even when the pressure in the first heat exchanger changes depending on the characteristics, an operation state, and a change in the operation state of the cryostat, or individuality and a maintenance condition of the freezer, this configuration can automatically regulate the pressure and stably maintain the recondensation of the heat-exchanging helium.

In this configuration, it is desirable that: the cryostat further includes an auxiliary coolant tank surrounding the helium tank and tightly closed to store a thermally-insulating auxiliary coolant in liquid, and the freezer further includes a sub-cooling part arranged at a position different from the main cooling part and kept at a very low temperature. The configuration desirably further includes an auxiliary coolant recondensing unit which recondenses the thermally-insulating auxiliary coolant in the auxiliary coolant tank by receiving cold energy from the sub-cooling part of the freezer. The auxiliary coolant recondensing unit desirably further includes: a second heat exchanger located above a liquid surface of the thermally-insulating auxiliary coolant in the auxiliary coolant tank, and having a second inner space separated from the thermally-insulating auxiliary coolant in the auxiliary coolant tank for storing a heat-exchanging auxiliary coolant in liquid, the second heat exchanger taking heat of vaporization for evaporation of the heat-exchanging auxiliary coolant in the second inner space, from the vapor of the thermally-insulating auxiliary coolant in the auxiliary coolant tank; a second recondensing chamber located away from the cryostat but in thermally contact with the sub-cooling part, supported by the support mechanism at a higher position than the auxiliary coolant tank, and configured to receive vapor of the heat-exchanging auxiliary coolant in the second inner space, recondense and liquefy the received vapor of the heat-exchanging auxiliary coolant by receiving the cold energy from the sub-cooling part, and discharge the recondensed and liquefied heat-exchanging auxiliary coolant; and a second connection part continuously extending downward from the second recondensing chamber to the second heat exchanger located in the cryostat to define a flow passage for permitting the heat-exchanging auxiliary coolant to flow between the second recondensing chamber and the second heat exchanger so that the thermally-insulating auxiliary coolant discharged from the second recondensing chamber flows to the second inner space of the second heat exchanger by gravity.

According to this configuration, when the thermally-insulating auxiliary coolant evaporates in the auxiliary coolant tank of the cryostat, the second heat exchanger takes the heat from the thermally-insulating auxiliary coolant, thereby permitting the heat-exchanging auxiliary coolant to recondense. This can consequently prevent the thermally-insulating auxiliary coolant in the auxiliary coolant tank from evaporating and reducing, and thus can further stably cool the helium tank. This configuration where an air component existing in the auxiliary coolant tank never passes through the second connection part can prevent the air component from freezing in a flow passage defined by the second connection part and clogging the flow passage.

In the configuration, the second recondensing chamber desirably has a second lower surface slanting downward to the second connection part.

This configuration achieves a stable inflow of the heat-exchanging auxiliary coolant recondensed in the second recondensing chamber into the second connection part.

In the configuration, the second connection part desirably has a second flexible section made of flexible member and arranged at least between the second heat exchanger and the second recondensing chamber.

This configuration can suppress propagation of the vibration of the freezer to the cryostat through the second connection part.

In the configuration, the freezer desirably includes: a cylinder having a cylindrical shape and a central axis extending in an up-down direction; a displacer arranged in the cylinder reciprocatively movable upward and downward in the up-down direction for generating cold energy by expanding coolant gas in the cylinder; and a drive part located below the cylinder for generating a drive force to reciprocatively move the displacer upward and downward. The sub-cooling part is desirably connected to the cylinder above the drive part for cooling the second recondensing chamber by receiving the cold energy. The main cooling part is desirably connected to the cylinder above the sub-cooling part for cooling the first recondensing chamber at a lower temperature than a temperature of the second recondensing chamber by receiving the cold energy.

According to this configuration, the freezer of two-stage type including the main cooling part and the sub-cooling part is used to thereby succeed in stable recondensation of the coolant helium and the thermally-insulating auxiliary coolant in the cryostat. Besides, the freezer has the drive part located below the cylinder, and thus each of the main cooling part and the sub-cooling part is arrangeable at a higher position than the drive part. This configuration can suppress an increase in the height of the topmost portion of the helium recondensation apparatus for a cryostat in the location thereof, and further permits the heat-exchanging helium discharged from the first recondensing chamber to flow into the first heat exchanger and permits the heat-exchanging auxiliary coolant discharged from the second recondensing chamber to flow into the second heat exchanger by gravity more effectively than a configuration where the drive part is located above the cylinder.

The present invention provides a helium recondensation apparatus for a cryostat, which can stably recondense vapor of helium in the cryostat while preventing a pipeline for the recondensation from being clogged.

The invention claimed is:

1. A helium recondensation apparatus for a cryostat which includes a helium tank closed to store coolant helium in liquid and accommodates a cooled object immersed in the coolant helium, the apparatus being connected to the cryostat for recondensing vapor of the coolant helium in the helium tank, and comprising:

a freezer located away from the cryostat and including a main cooling part kept at a cryogenic temperature; and a helium recondensing unit which recondenses the coolant helium in the helium tank by receiving cold energy from the main cooling part of the freezer, wherein the helium recondensing unit includes:

a first heat exchanger located above a liquid surface of the coolant helium in the helium tank, and having a first inner space separated from the coolant helium in the helium tank for storing heat-exchanging helium in liquid, the first heat exchanger taking heat of vaporization for evaporation of the heat-exchanging helium in the inner space, from the vapor of the coolant helium in the helium tank;

a first recondensing chamber located away from the cryostat but in thermal contact with the main cooling part, and configured to receive vapor of the heat-exchanging helium in the first inner space, recondense and liquefy the received vapor of the heat-exchanging helium by receiving the cold energy from the main cooling part, and discharge the recondensed and liquefied heat-exchanging helium;

a housing which supports the first recondensing chamber so that the first recondensing chamber is at a higher position than the helium tank; and a first connection part continuously extending downward from the first recondensing chamber to the first heat exchanger located in the cryostat to define a flow passage for permitting the heat-exchanging helium to flow between the first recondensing chamber and the first heat exchanger so that the heat-exchanging helium discharged from the first recondensing chamber flows to the first inner space of the first heat exchanger by gravity.

2. The helium recondensation apparatus for a cryostat according to claim 1, wherein the first connection part has:

a forward section which connects the first inner space of the first heat exchanger and the first recondensing chamber to each other for permitting the vapor of the heat-exchanging helium in the first inner space to flow into the first recondensing chamber; and a backward section which is independent of the forward section and connects the first inner space of the first heat exchanger and the first recondensing chamber to each other for permitting the heat-exchanging helium recondensed in the first recondensing chamber to flow into the first inner space.

3. The helium recondensation apparatus for a cryostat according to claim 2, wherein the first recondensing chamber has:

an inlet connection port for permitting the heat-exchanging helium to flow into the first recondensing chamber from the forward section; and an outlet connection port located below the inlet connection port for permitting the heat-exchanging helium to flow out to the backward section from the first recondensing chamber.

4. The helium recondensation apparatus for a cryostat according to claim 1, wherein the first connection part includes a single pipeline connecting the first inner space of the first heat exchanger and the first recondensing chamber to each other for permitting the vapor of the heat-exchanging helium in the first inner space to flow into the first recondensing chamber, and permitting the heat exchanging helium recondensed in the first recondensing chamber to flow into the first inner space.

5. The helium recondensation apparatus for a cryostat according to claim 1, wherein the first recondensing chamber has a first lower surface slanting downward to the first connection part.

6. The helium recondensation apparatus for a cryostat according to claim 1, wherein the first connection part has a first flexible section made of a flexible member and arranged at least between the first heat exchanger and the first recondensing chamber.

7. The helium recondensation apparatus for a cryostat according to claim 1, wherein a helium buffer tank connected to the first recondensing chamber for transferring the heat-exchanging helium between the helium buffer tank and the first recondensing chamber, and having a capacity which is larger than a sum of a capacity of the first recondensing chamber and a capacity of the first inner space.

8. The helium recondensation apparatus for a cryostat according to claim 7, further comprising:

a helium reservoir tank which is independent of the first recondensing chamber and connected to the helium buffer tank for transferring the heat-exchanging helium between the helium reservoir tank and the helium buffer tank; and a pressure regulating assembly including a pump and valves which regulates a transfer amount of the heat-exchanging helium between the helium buffer tank and the helium reservoir tank so that a pressure in the helium buffer tank falls within a predetermined range.

9. The helium recondensation apparatus for a cryostat according to claim 8, wherein the pump of the pressure regulating assembly includes a helium pump arranged between the helium buffer tank and the helium reservoir tank, the valves of the pressure regulating assembly include:

an intake-side switch valve disposed on an intake side of the helium pump for switching a supply source of supplying the heat-exchanging helium to the helium pump between the helium buffer tank and the helium reservoir tank; and a discharge-side switch valve disposed on a discharge side of the helium pump for switching a discharge destination to which the heat-exchanging helium is discharged between the helium buffer tank and the helium reservoir tank.

10. The helium recondensation apparatus for a cryostat according to claim 8, wherein the helium reservoir tank has:

a low-pressure reservoir tank part having a lower pressure than the helium buffer tank; and a high-pressure reservoir tank part having a higher pressure than the helium buffer tank, the pump of the pressure regulating assembly includes a helium pump arranged between the low-pressure reservoir tank part and the high-pressure reservoir tank part; and the valves of the pressure regulating assembly include:

a helium low-pressure valve disposed between the helium pump and the low-pressure reservoir tank part, and openable to permit the heat-exchanging helium to flow out to the low-pressure reservoir tank part from the helium buffer tank in response to an operation of the helium pump; and a helium high-pressure valve disposed between the helium pump and the high-pressure reservoir tank part, and openable to permit the heat-exchanging helium to flow into the helium buffer tank from the high-pressure reservoir tank part in response to an operation of the helium pump.

11. The helium recondensation apparatus for a cryostat according to claim 1, wherein the cryostat further includes an auxiliary coolant tank surrounding the helium tank and closed to store a thermally-insulating auxiliary coolant in liquid, and the freezer further includes a sub-cooling part arranged at a position different from the main cooling part and kept at a cryogenic temperature, the apparatus further comprising:

an auxiliary coolant recondensing unit which recondenses the thermally-insulating auxiliary coolant in the auxiliary coolant tank by receiving cold energy from the sub-cooling part of the freezer, the auxiliary coolant recondensing unit includes:

a second heat exchanger located above a liquid surface of the thermally-insulating auxiliary coolant in the auxiliary coolant tank, and having a second inner space separated from the thermally-insulating auxiliary coolant in the auxiliary coolant tank for storing a heat-exchanging auxiliary coolant in liquid, the second heat exchanger taking heat of vaporization for evaporation of the heat-exchanging auxiliary coolant in the second inner space, from the vapor of the thermally-insulating auxiliary coolant in the auxiliary coolant tank;

a second recondensing chamber located away from the cryostat but in thermal contact with the sub-cooling part, supported by the housing at a higher position than the auxiliary coolant tank, and configured to receive vapor of the heat-exchanging auxiliary coolant in the second inner space, recondense and liquefy the received vapor of the heat-exchanging auxiliary coolant by receiving the cold energy from the sub-cooling part, and discharge the recondensed and liquefied heat-exchanging auxiliary coolant; and a second connection part continuously extending downward from the second recondensing chamber to the second heat exchanger located in the cryostat to define a flow passage for permitting the heat-exchanging auxiliary coolant to flow between the second recondensing chamber and the second heat exchanger so that the thermally-insulating auxiliary coolant discharged from the second recondensing chamber flows to the second inner space of the second heat exchanger by gravity.

12. The helium recondensation apparatus for a cryostat according to claim 11, wherein the second recondensing chamber has a second lower surface slanting downward to the second connection part.

13. The helium recondensation apparatus for a cryostat according to claim 11, wherein the second connection part has a second flexible section made of a flexible member and arranged at least between the second heat exchanger and the second recondensing chamber.

14. The helium recondensation apparatus for a cryostat according to claim 11, wherein the freezer further includes:

a cylinder having a cylindrical shape and a central axis extending in an up-down direction;

a displacer arranged in the cylinder reciprocatively movable upward and downward in the up-down direction for generating cold energy by expanding coolant gas in the cylinder; and a drive part located below the cylinder for generating a drive force to reciprocatively move the displacer upward and downward, the sub-cooling part is connected to the cylinder above the drive part for cooling the second recondensing chamber by receiving the cold energy, and the main cooling part is connected to the cylinder above the sub-cooling part for cooling the first recondensing chamber at a lower temperature than a temperature of the second recondensing chamber by receiving the cold energy.

* * * * *